United States Patent [19]

Mae et al.

[11] 4,354,460

[45] Oct. 19, 1982

[54] VARIABLE VALVE EVENT ENGINE

[75] Inventors: Hisao Mae, Susono; Masaaki Takizawa, Mishima; Noboru Matsubara, Susono, all of Japan

[73] Assignee: Toyota Jidosha Kogyo Kabushiki Kaisha, Tokyo, Japan

[21] Appl. No.: 142,629

[22] Filed: Apr. 22, 1980

[30] Foreign Application Priority Data

May 9, 1979 [JP] Japan ..... 54-55635

[51] Int. Cl.[3] ..... F01L 1/34

[52] U.S. Cl. ..... 123/90.16; 123/90.39

[58] Field of Search ..... 123/90.12, 90.13, 90.16, 123/90.15, 90.39, 90.41, 90.17, 90.18

[56] References Cited

U.S. PATENT DOCUMENTS 2,484,109 10/1949 Meinecke ..... 123/90.16
3,878,822 4/1975 Beal ..... 123/90.16
4,182,289 1/1980 Nakajima et al. ..... 123/90.39
4,253,434 3/1981 Takizawa et al. ..... 123/90.16
4,258,671 3/1981 Takizawa et al. ..... 123/90.16

*Primary Examiner*—Craig R. Feinberg
*Assistant Examiner*—W. R. Wolfe
*Attorney, Agent, or Firm*—Finnegan, Henderson, Farabow, Garrett & Dunner

[57] ABSTRACT

A variable valve event engine has a plurality of cams with different cam profiles and can vary the operating characteristics of the valve by moving a rocker arm for selectively changing the cams in accordance with changes in the operating conditions of the engine. The engine further includes a spring urging member which causes a certain amount of energy to be retained in a spring for rapidly changing the cams. The engine has a detector for sensing the temperature of the lubricant utilized in a hydraulic member for moving the rocker arm so that the movement of the rocker arm is effected only when the lubricant temperature is higher than a predetermined temperature.

9 Claims, 4 Drawing Figures

VARIABLE VALVE EVENT ENGINE

BRIEF DESCRIPTION OF THE INVENTION

The present invention relates to a variable valve event engine which can vary the operating characteristics of a valve installed in an internal combustion engine, such as an intake valve or an exhaust valve, in accordance with changes in the operating conditions of the engine.

BACKGROUND OF THE INVENTION

Generally, the operating characteristics of a conventional engine are influenced by the operating characteristics of the cams which actuate the valves of the engine. For example, if the shape of the cams is selected so as to produce a high torque when the engine including the cams rotates at a low speed, the engine cannot produce a sufficiently high torque at a high rotating speed. On the other hand, if the shape of the cams is selected so that an engine having the cams can produce a high torque at a high rotating speed, the output of the engine is decreased when the engine speed is low. As a result, a conventional engine cannot always produce a high torque for various rotating speeds of the engine.

To increase the torque characteristics of an engine for various rotating speeds of the engine, U.S. Pat. No. 3,878,822, issued to Beal, discloses a variable valve event engine comprising: a rocker shaft disposed along the engine; a rocker arm for actuating a valve of the engine, which arm is pivoted swingably around and slidably along the rocker shaft; a camshaft arranged parallel to the rocker shaft and synchronized with a crankshaft of the engine; and a plurality of adjacent cams fixed in such an arrangement on the camshaft as to have profiles different from each other, wherein by sliding the rocker arm along the rocker shaft, the valve is selectively actuated by means of one of the cams.

However, the engine disclosed in U.S. Pat. No. 3,878,822 has several disadvantages in actual operation. For example, since the rocker arm is moved by means of an electromagnetic solenoid, the force for moving the rocker arm is small. In addition, since the rocker shaft itself is moved by the electromagnetic solenoid, the moving speed of the rocker arm is very slow.

To overcome such disadvantages, in U.S. Pat. No. 4,253,434 which is assigned to the same assignee as the present application, a variable valve event engine is disclosed. The engine comprises: a rocker shaft disposed along the engine; a rocker arm for actuating a valve of the engine, the rocker arm being pivotably and slidably disposed on the rocker shaft; a hydraulic member for moving the rocker arm along the rocker shaft; a camshaft disposed parallel to the rocke shaft and synchronized with a crank shaft of the engine; a plurality of cams having cam profiles different from each other fixed on the cam shaft so as to be adjacent to each other; a rocker arm slide shaft disposed parallel and longitudinally movable with respect to the rocker shaft, and; a spring connecting the rocker arm slide shaft to the rocker arm for transmitting movement of the rocker arm slide shaft to the rocker arm; wherein by sliding the rocker arm along the rocker shaft, the valve is selectively actuated by means of one of the cams.

In such a variable valve event engine as described in the above-mentioned United States Patents, the rocker arm must be rapidly moved while the rocker arm is positioned at base circular portions which are common to the adjacent two cams having different cam profiles, so that abrasion and damage of the rocker arm and cams is prevented and so that the smooth switching of the rocker arm can be effected. For this purpose, the above-mentioned U.S. Pat. No. 4,253,434 discloses; a spring urging member for retaining a predetermined amount of energy which is utilized to move the rocker arm rapidly, and; a stopper guide positioned between two adjacent cams which prevents the rocker arm from moving at a position different from the common base circular portion.

The inventors of the present invention confirmed that in many cases the above-mentioned spring urging member and the stopper guide are very effective, but that under some driving conditions they observed an unfavorable phenomenon occuring in that the movement of the rocker arm cannot be completed during the common base circular portions of the cams. Through careful investigation, the inventors found that such unfavorable phenomenon occurs just after the engine is started and when the viscosity of the lubricant within the lubricating system in the engine is high since the temperature of the lubricant is low. More specifically, the phenomenon is caused by the fact that the moving speed of the rocker arm is low since the viscosity of the lubricant is high and, accordingly, the rocker arm cannot move rapidly between the cams.

BRIEF SUMMARY OF THE INVENTION

An object of the present invention is to provide an improved variable valve event engine wherein the rocker arm is slid by means of the hydraulic member only when the temperature of the lubricant is higher than a predetermined temperature so that the rocker arm is moved rapidly between the cams.

The object is achieved by a variable valve event engine comprising: a rocker shaft disposed along the engine; a rocker arm for actuating a valve of the engine, the rocker arm being pivotally and slidably disposed on the rocker shaft; a hydraulic member for sliding the rocker arm along the rocker shaft; a detector for sensing the temperature of the lubricant utilized in the hydraulic member; a camshaft disposed parallel to the rocker shaft and synchronized with a crankshaft of the engine; and a plurality of cams having cam profiles different from each other fixed on the cam shaft so as to be adjacent to each other; whereby the rocker arm is slid by means of the hydraulic member only when the detector detects that the temperature of the lubricant is higher than a predetermined temperature so that the valve is selectively actuated by means of one of the cams.

According to the present invention, a cam to be used during low speed and a cam to be used during high speed, both having the differing cam profiles, are disposed and selectively utilized in accordance with the operating conditions of the engine which has the cams installed thereon.

A criterion for determining the alternation of the cams will now be explained. Two diagrams (not shown), one showing the operating characteristics of engines with cams for high speeds and the other showing the operating characteristics of engines with cams for low speeds, were prepared with values corresponding to the engine operating characteristics being plotted on the ordinate of each graph while values corresponding to the engine rotating speeds are plotted on the abscissa thereof. The abscissa is partitioned into two regions, a high speed region and a low speed region, the boundary between the regions is formed by a vertical line defined by the intersection of the above-mentioned two diagrams. During low speed conditions, the cam for low speed use is adopted, while during high speed conditions, the cam for high speed use is adopted.

According to the present invention, the cams for low speed and high speed uses can be selectively utilized in accordance with changes in the engine rotating speed, with regard to whether the engine rotating speed is high or low. As a result, the operating torque characteristic of the engine is highly improved if compared with that of a conventional engine which has a single type of cam installed thereon. In addition, the variable valve event engine, according to the present invention, can generate uniform torque characteristics for various engine rotating speeds. The uniform torque obtained by the engine of the present invention can be almost the same as the maximum torque obtained by the conventional engine with a single type cam.

The valve timing (including the valve lift) of the intake and exhaust valves mounted on an engine is adjusted in accordance with changes in the operating conditions of the engine, in other words, with changes in the driving conditions of a vehicle in which the engine is mounted. Such adjustment can be effected by means of the present invention for maintaining a high engine efficiency and for improving the output characteristics and the fuel consumption of the engine during both low and high speed conditions.

An embodiment of the present invention will be explained hereinafter with reference to the accompanying drawings.

DETAILED DESCRIPTION OF THE PREFERRED EMBODIMENT

Figure 1:
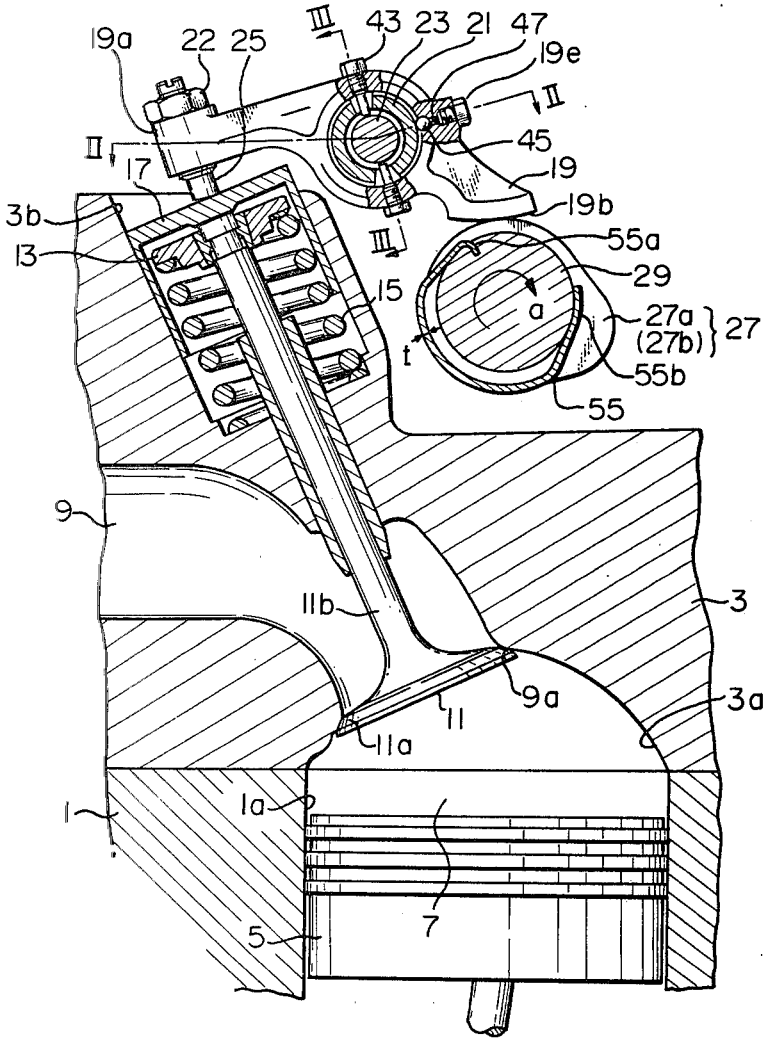
FIG. 1 is a cross-sectional elevational view of an embodiment according to the present invention.

With reference to FIG. 1, which is a cross-sectional elevational view of an embodiment of the present invention, mounted and secured onto a cylinder block 1 with a cylinder bore 1*a* formed therein is a cylinder head 3 with a combustion chamber wall 3*a* formed thereon. A piston 5 is slidably and sealingly disposed within the cylinder bore 1*a* so that the space surrounded by the cylinder bore 1*a*, the combustion chamber wall 3*a* and the upper surface of the piston 5 forms a combustion chamber 7. An intake port 9, which is formed in the cylinder head 3 and communicated with an intake manifold (not shown), and an exhaust port (not shown), which is also formed in the cylinder head 3 and communicated with an exhaust manifold (not shown), are both communicated with the combustion chamber 7 via an intake valve 11, which controls the intake of a gas mixture into the combustion chamber 7, and via an exhaust valve (not shown), which controls the flow of exhaust gas from the combustion chamber 7.

Since the constructions of the intake valve 11 and the exhaust valve are similar to each other, only the construction of the intake valve 11 will now be described. The intake valve 11 comprises a valve body 11*a*, which cooperates with a valve seat 9*a* formed at the opening portion of the intake port 9 of the combustion chamber 7 for controlling the intake of the gas mixture, and a valve rod 11*b* which is fixed to the valve body 11*a*. The valve rod 11*b* is slidably and sealingly inserted into the cylinder head 3 and has a spring retainer 13 fixed on its rear portion which projects from the cylinder head 3. A compression spring 15 is mounted between the spring retainer 13 and the upper surface of the cylinder head 3 for urging the intake valve 11 upwardly so that the valve body 11*a* can abut against the valve seat 9*a*. Mounted on the valve rod 11*b* of the intake valve 11 is a cylindrical-shaped valve lifter 17 which is slidable within a cylindrical recess 3*b* formed in the cylinder head 3. When the upper surface of the valve lifter 17 is pushed downwardly, the intake valve 11 is opened. A rocker arm 19 adapted to be swingable around a rocker shaft 21 has a knocker 25 which is threadedly secured with a lock nut 22 to one end thereof so that the length of the knocker 25 is adjustable. A cam member 27 is in abutment with a rocker arm pad 19*b* formed at the other end of the rocker arm 19 so that, when the cam 27 is rotated in the direction designated by the arrow a in FIG. 1, the knocker 25 pushes the valve lifter 17 downwardly for opening the intake valve 11.

Figure 2:
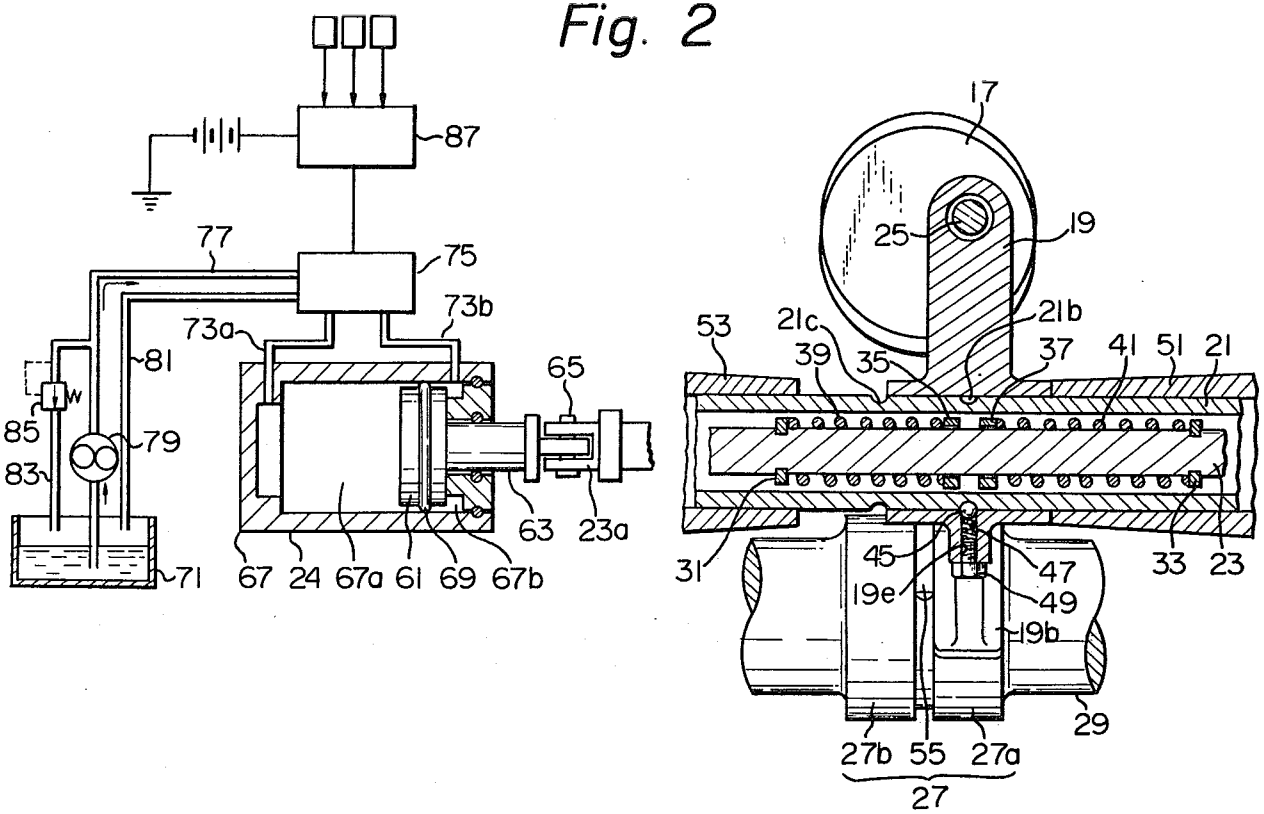
FIG. 2 is a cross-sectional view taken along the line II—II in FIG. 1.

As illustrated in FIG. 2, the cam member 27 includes two adjacent cams 27*a* and 27*b* which are fixed on a camshaft 29 disposed parallel to the rocker shaft 21. The cam profiles of the cams 27*a* and 27*b* are different from each other with respect to their valve lifts and/or valve timings, for example, the cam 27*a* has a cam profile preferable for use during a low speed condition and the cam 27*b* has a cam profile preferable for use during a high speed condition. It should be noted that the number of cams is not limited to two but may be three or more according to preference, and that the base circular portions of the cams 27*a* and 27*b* have substantially the same radii. The camshaft 29 is synchronized with the crankshaft of the engine (not shown) and rotated in a direction designated by the arrow a (FIG. 1).

As mentioned above, the rocker arm 19 is not only swingably pivoted to the rocker shaft 21 but also adapted to be slidable along the rocker shaft 21 so that the rocker arm 19 can selectively transmit the movement of each of the cams 27*a* and 27*b* to the valve lifter 17. The slide mechanism of the rocker arm 19 will now be explained with reference to FIG. 1 through 3. The rocker shaft 21 is a hollow cylinder and the rocker arm 19 is swingably and slidably inserted onto the outside wall of the hollow cylinder. A rocker arm slide shaft 23 is disposed inside the hollow cylinder with a certain clearance therebetween and extends along the rocker shaft 21. One end 23*a* of the rocker arm slide shaft 23 is connected to a hydraulic member, such as a hydraulic cylinder 24 (illustrated in FIG. 2), wherein lubricant is used, for moving the rocker arm slide shaft 23 along the rocker shaft 21.

Figure 3:
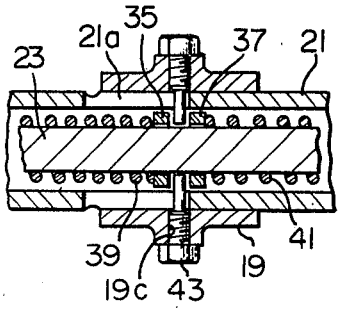
FIG. 3 is a cross-sectional view taken along the line III—III in FIG. 1.

The rocker arm slide shaft 23 has two annular-shaped stops 31 and 33 fixed thereon with a certain distance therebetween along the lengthwise direction of the slide shaft 23. Two movable stops 35 and 37 are slidably mounted between the stops 31 and 33 on the rocker arm slide shaft 23 with a small distance therebetween. Connecting compression springs 39 and 41 are installed between the stops 31 and 35, and 33 and 37, respectively. According to the above-mentioned construction, stops 35 and 37 are located at predetermined positions which are determined by the biasing forces generated by the compression springs 39 and 41. As illustrated in FIG. 3, the rocker shaft 21 has a slot 21*a* formed thereon through which a bolt 43 threaded to the rocker arm 19 extends to a space located between the stop 35 and 37, so that the rocker arm 19 is adapted to be movable with the stops 35 and 37. In the embodiment which is illustrated in the accompanying FIG. 2, the rocker shaft 21 has two circumferential grooves 21*b* and 21*c* formed on the circumference thereof at positions which correspond to the cams 27*a* and 27*b*. The rocker arm 19 has a small hole 19*e* formed therein. A ball 45 which is capable of being selectively engaged with the circumferential groove 21*b* or 21*c* is retained in the hole 19*e* and then urged by a spring 47 so that the rocker arm 19 is in position. A screw bolt 49 is used for retaining the spring 47.

The hydraulic cylinder 24 includes: a piston 61 having a piston rod 63 projecting therefrom and connected to the rocker arm slide shaft 23 via a pin 65, and a cylinder 67 which sealingly engages with the piston 61 via an O-ring 69. The cylinder 67 is partitioned into two cylinder chambers 67*a* and 67*b* by the piston 65.

The cylinder chambers 67*a* and 67*b* are communicated with an oil pan 71 through oil pipes 73*a* and 73*b*, a four port two directional control valve 75, an oil supply pipe 77, a hydraulic pump 79 and a return pipe 81. A relief pipe 83 is branched from the oil supply pipe 77 to the oil pan 71 and has a relief valve 85 so that the pressure of the supply oil is kept at a predetermined value.

The control valve 75 has an electromagnetic solenoid 75*a* and a spring 75*b* (FIG. 4) and is actuated by a control 87, as will be explained later in detail with reference to FIG. 4.

When the rocker arm slide shaft 23 is moved to the left from the position illustrated in FIG. 2 by means of the hydraulic cylinder 24, the contacting compression spring 41 is compressed by the stop 33 so that the stop 37 is urged to the left. However, since the ball 45 is engaged with the circumferential groove 21*b* formed around the rocker shaft 21, the stop 37 cannot be moved for a while. On the other hand, as the contacting compression spring 41 is compressed, potential energy is retained in the compression spring 41. When the retained potential energy becomes more than a predetermined value, due to the urging force generated by the compression spring 41, the ball 45 is disengaged from the circumferential groove 21*b*. The rocker arm 19 is next moved within a short period to a position corresponding to the other cam 27*b* by means of the potential energy retained in the compression spring 41 and then positioned there by engaging the ball with the other circumferential groove 21*c*. The strength of the connecting compression spring 41 is so adjusted that the rocker arm 19 can be moved a certain distance between the cams 27*a* and 27*b*, i.e., the distance between the annular grooves 21*b* and 21*c*. Similarly the rocker arm 19 is moved to the right, as seen in FIG. 2, by means of the connecting compression spring 39 when the rocker arm slide shaft 23 is moved to the right. The strength of the compression spring 39 is likewise adjusted so that the rocker arm 19 can be moved a certain distance between the cams 27*a* and 27*b*. The amount of movement of the rocker arm 19 can be limited by covers 51 and 53 which are inserted on the rocker shaft 21 as illustrated in FIG. 2, in addition to the ball 45 and the circumferential grooves 21*b* and 21*c* which are also used for limiting the movement of the rocker arm 19.

It is preferable that the above-mentioned movement of the rocker arm 19 be effected while the rocker arm pad 19*b* (FIG. 1) is in abutment with a base circular portion of one of the adjacent cams 27*a* and 27*b*. If movement of the rocker arm 19 is not effected under such condition, the rocker arm 19 and/or cams 27*a* and 27*b* may be abraded or damaged when the rocker arm 19 is being moved. This is because the cams 27*a* and 27*b* have different cam profiles with respect to the valve lifts and/or valve timings. As a result, the smooth operation of the engine is disturbed.

In this embodiment, a stopper guide 55 is disposed between the two adjacent cams 27*a* and 27*b* (FIG. 2) to permit the rocker arm 19 to move only when the rocker arm is in abutment with one of the base circular portions of the cams 27*a* and 27*b*. Referring to FIG. 1 again, one end 55*a* of the stopper guide 55 is fixed, at an intermediate portion in the base circles of the cams 27*a* and 27*b*, to the camshaft 29 and the other end 55*b* of the stopper guide 55 is partially wrapped around the camshaft 29 at a trailing portion with respect to the rotational direction of the camshaft 29. The intermediate portion of the stopper guide 55 for connecting both the ends 55*a* and 55*b* is formed in a circular arc shape, and the outside periphery of the intermediate portion of the stopper guide bulges out from the base circles of the cams 27*a* and 27*b* by a certain amount "t", for example, 1 mm. The stopper guide 55, made of a spring steel strip, is so constructed and arranged that the stopper guide 55 is rigid against a force acting on the side thereof (i.e., in a direction perpendicular to the sheet on which FIG. 1 is illustrated) but flexible against a force acting on the surface thereof (i.e., in a direction parallel to the sheet on which FIG. 1 is illustrated). As a result, when the rocker arm pad 19*b* formed on the rocker arm 19 is in abutment with a base circular portion but free from the stopper guide 55 of one of the cams 27*a* and 27*b*, and when the rocker arm 19 commences to move, the rocker arm 19 cannot be prevented from moving by the stopper guide 55 and is thus caused to move by the energy retaining and rapidly moving mechanism. In addition, even if the rocker arm pad 19*b* should run onto the stopper guide 55 while the rocker arm 19 is moving, the movement of the rocker arm 19 still cannot be prevented because the stopper guide may be easily deflected elastically. On the other hand, while the rocker arm pad 19*b* formed on the rocker arm 19 is in abutment with a portion free from the base circular portion, such as a lift portion, of one of the cams 27*a* and 27*b*, the rocker arm 19 is prevented from moving because the urging forces generated by the connecting compression springs 27*a* and 27*b* are so adjusted that the urging forces are smaller than the frictional forces occurring between the cam 27*a* or 27*b* and the rocker arm pad 19*b* while the intake valve 11 is being opened by the cam 27*a* or 27*b*. In addition, while the rocker arm pad 19*b* is in abutment with a rear half portion of the base circle of the cam 27*a* or 27*b*, in other words, a portion where the stopper guide 55 is disposed, the movement of the rocker arm 19 is prevented by the projecting portion of the stopper guide 55. As a result, the movement of the rocker arm 19 is prevented while it is in abutment with a portion free from the base circles of the cam 27*a* or 27*b* so that defects, such as vibrations of the cam, are completely prevented from occurring. In this case, the rocker arm 19 which has been prevented from moving is moved when the rocker arm 19 comes into abutment with the base circular portion of the cam 27*a* or 27*b*.

To facilitate the smooth movement of the rocker arm 19, the width of the rocker arm pad 19*b* measured along the cam shaft 29 should preferably be greater than the width of the clearance between the cams 27*a* and 27*b*. In other words, the clearance between the cams 27*a* and 27*b* should preferably be as small as possible in order to maintain a minimum amount of movement of the rocker arm 19. The amount of movement of the rocker arm 19 is so limited that the knocker 25 threaded at the front portion of the rocker arm 19 cannot be disengaged from the valve lifter 17 when the rocker arm 19 is moved.

As explained above, if the temperature of the lubricant in the hydraulic cylinder 24 is lower than a predetermined temperature, the rocker arm 19 cannot move rapidly because of the high viscosity of the lubricant, and accordingly, the cam 27*a* or 27*b* and the rocker arm 19 may be abraded and damaged when the rocker arm 19 is moved. To prevent such abrasion and damage of the cams 27*a* and 27*b* and the rocker arm 19, according to the present invention, the rocker arm 19 can be moved only when the temperature of the lubricant is higher than a predetermined value. Referring to FIG. 4, the electromagnetic solenoid 75*a* of the control valve 75 is communicated with a power source, such as a series of batteries 89, via the control 87. The control 87 includes three switches 91, 92 and 93 connected in series. The switch 91 is actuated by a conventional temperature detector 95 disposed in a hydraulic system for actuating the hydraulic cylinder 24, so that the switch 91 is closed when the detector 95 detects the temperature of the lubricant is higher than a predetermined value. The switch 92 is actuated by a conventional tachometer type rotational speed detector 96 disposed on the engine so that the switch 92 is closed when the detector 96 detects the rotational speed of the engine is higher than a predetermined value. Similarly the switch 93 is actuated by a conventional detector 97 for sensing the load of the engine so that the switch 93 is closed when the detector 97 detects the load of the engine is heavier than a predetermined value. The detector 97 may be a conventional vacuum switch disposed on an intake pipe of the engine or a limit switch actuated by an accelerator operated by a driver.

When the electromagnetic solenoid 75*a* is not energized, the spool mounted in the control valve 75 is moved by means of the spring 75*b*, and accordingly, the left cylinder chamber 67*a* is filled with the lubricant supplied from the oil pan 71 through the hydraulic pump 77, oil supply pipe 77 and the oil pipe 73, and then, the piston 61 moves to the right. Contrary to this, when the electromagnetic solenoid 75*a* is energized, the right cylinder chamber 67*b* is filled with the lubricant, and accordingly, the piston 61 moves to the left.

Figure 4:
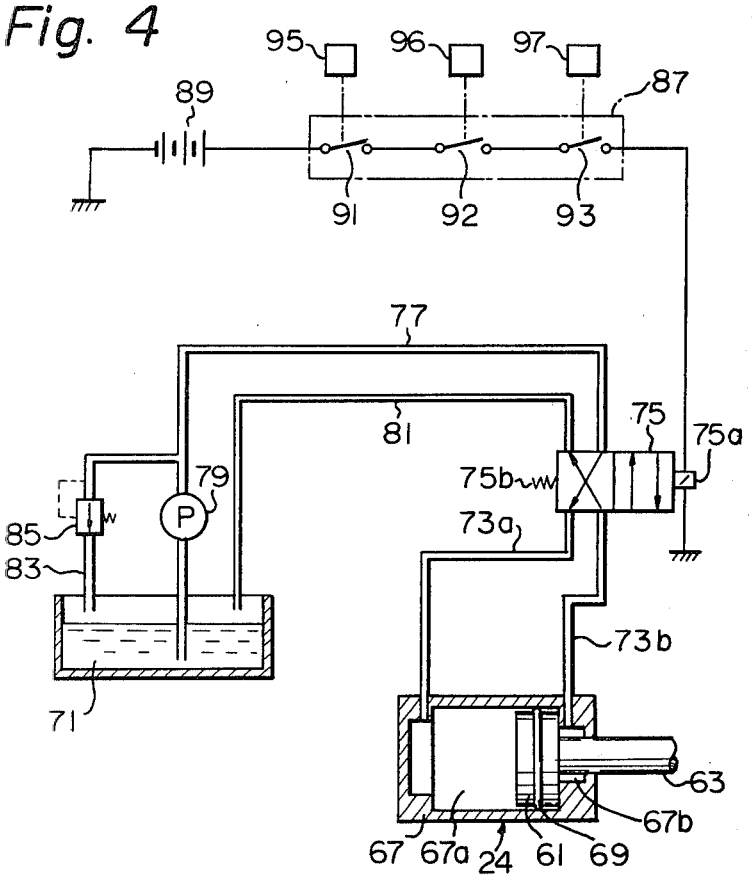
FIG. 4 is an electric and hydraulic circuit diagram utilized in the embodiment illustrated in FIGS. 1 through 3.

The electromagnetic solenoid 75*a* illustrated in FIG. 4 is energized only when the detectors 95, 96 and 97 detect the temperature of the lubricant, the rotational speed of the engine and the load of the engine are higher than predetermined values, respectively. Accordingly, the rocker arm 19 (FIG. 2) is moved from the cam 27*a* with the low speed profile to the cam 27*b* with the high speed profile only when the lubricant in the hydraulic cylinder 24 is warm and the viscosity thereof is low. As a result, the abrasion and the damage of the cams 27*a* and 27*b* and the rocker arm 19 (FIG. 2) caused because of the high viscosity of the lubricant can be prevented.

The predetermined value of the detector 95 is constant regardless of the rotational speed and the load of the engine in the embodiment illustrated in FIG. 4. However, the predetermined value of the detector 95 may be varied in accordance with the rotational speed and/or the load of the engine. In an example, when the rotational speed of the engine is small, the predetermined value of the detector 95 is made small so that the rocker arm is moved when the temperature of the lubricant is higher than a comparatively low value. Such programming can be effected with ease by utilizing a computer type control, which is common in automobile technology, instead of the control 87 illustrated in FIG. 4. In this case, it is preferable that conventional analog type detectors be used for sensing the temperature of the lubricant, the rotatonal speed of the engine and the load of the engine, and the control includes comparators for comparing the detected analog signals with the predetermined values. Many alterations of the circuit in the control 87 will be obvious to those skilled in the art. For example, the switches 92 and 93 in FIG. 4 may be in parallel instead of being in series, or one of the switches 92 and 93 may be omitted. Likewise, various types of control valves may be utilized for controlling the actuation of the hydraulic cylinder 24.

We claim:

1. A variable valve event engine comprising:

a rocker shaft disposed along said engine;

a camshaft disposed parallel to said rocker shaft and synchronized with a crankshaft of said engine;

a plurality of cams having cam profiles different from each other fixed on said camshaft so as to be adjacent to each other;

a rocker arm for actuating a valve of said engine, said rocker arm being pivotably and slidably disposed on said rocker shaft;

a rocker arm slide shaft disposed parallel and longitudinally movable with respect to said rocker shaft;

a hydraulic member for longitudinally moving said rocker arm slide shaft;

a control valve for actuating said hydraulic member in accordance with changes in the operating conditions of the engine;

a spring connecting said rocker arm slide shaft with the rocker arm for transmitting the movement of said rocker arm slide shaft to said rocker arm to move said rocker arm between logitudinally spaced, predetermined positions, each being aligned with one of said cams;

a first detector for sensing the temperature of the lubricant utilized in said hydraulic member;

a second detector for sensing the rotational speed of the engine;

a third detector for sensing the load of said engine;

a control, connecting said control valve with said first, second and third detectors, for switching said control valve in accordance with the rotational speed and the load of the engine detected by said second and third detectors only when said first detector detects that the temperature of the lubricant is higher than said predetermined temperature.

2. A variable valve event engine comprising:

a rocker shaft disposed along said engine;

a camshaft disposed parallel to said rocker shaft and synchronized with a crankshaft of said engine;

a plurality of cams having cam profiles different from each other fixed on said camshaft so as to be adjacent to each other;

a rocker arm for actuating a valve of said engine, said rocker arm being pivotably and slidably disposed on said rocker shaft;

a rocker arm slide shaft disposed parallel and longitudinally movable with respect to said rocker shaft;

a hydraulic piston-cylinder having two cylinder chambers for longitudinally moving said rocker arm slide shaft;

a two-directional control valve for actuating said hydraulic piston-cylinder in accordance with changes in the operating conditions of the engine, said control valve being in fluid communication with said two cylinder chambers, with a hydraulic pump via a supply pipe, and with a reservoir via a return pipe, said supply pipe including a relief pipe and relief valve branching from said supply pipe between said pump and said control valve;

a spring connecting said rocker arm slide shaft with the rocker arm for transmitting the movement of said rocker arm slide shaft to said rocker arm to move said rocker arm between longitudinally spaced, predetermined positions, each being aligned with one of said cams;

a first detector for sensing the temperature of the lubricant utilized in said hydraulic piston-cylinder;

a second detector for sensing the load of said engine; and a control, connecting said control valve and said first and second detectors, for switching said control valve in accordance with the load of said engine detected by said second detector only when said first detector detects that said temperature of said lubricant is higher than a predetermined temperature.

3. A variable valve event engine comprising:

a rocker shaft disposed along said engine;

a camshaft disposed parallel to said rocker shaft and synchronized with a crankshaft of said engine;

a plurality of cams having cam profiles different from each other fixed on said camshaft so as to be adjacent to each other;

a rocker arm for actuating a valve of said engine, said rocker arm being pivotably and slidably disposed on said rocker shaft;

a rocker arm slide shaft disposed parallel and longitudinally movable with respect to said rocker shaft;

a hydraulic piston-cylinder having two cylinder chambers for longitudinally moving said rocker arm slide shaft;

a two-directional control valve for actuating said hydraulic piston-cylinder in accordance with changes in the operating conditions of the engine, said control valve being in fluid communication with said two cylinder chambers, with a hydraulic pump via a supply pipe, and with a reservoir via a return pipe, said supply pipe including a relief pipe and relief valve branching from said supply pipe between said pump and said control valve;

a spring connecting said rocker arm slide shaft with said rocker arm for transmitting movement of said rocker arm slide shaft to said rocker arm to move said rocker arm between logitudinally spaced, predetermined positions each being aligned with one of said cams;

a detector for sensing the temperature of the lubricant utilized in said hydraulic piston-cylinder; and control means connected to said control valve and said detector for switching said control valve only when said detector detects that said temperature of said lubricant is higher than a predetermined temperature so that said valve is selectively actuated by means of one of said cams.

4. A variable valve event engine according to claim 3, wherein said rocker shaft is a hollow cylinder and said rocker arm slide shaft extends inside of said hollow cylinder.

5. A variable valve event engine comprising:

a rocker shaft disposed along said engine;

a camshaft disposed parallel to said rocker shaft and synchronized with a crankshaft of said engine;

a plurality of cams having cam profiles different from each other fixed on said camshaft so as to be adjacent to each other;

a rocker arm for actuating a valve of said engine, said rocker arm being pivotably and slidably disposed on said rocker shaft;

a rocker arm slide shaft disposed parallel and longitudinally movable with respect to said rocker shaft;

a hydraulic piston-cylinder having two cylinder chambers for longitudinally moving said rocker arm slide shaft;

a two-directional control valve for actuating said hydraulic piston-cylinder in accordance with changes in the operating conditions of the engine, said control valve being in fluid communication with said two cylinder chambers, with a hydraulic pump via a supply pipe, and with a reservoir via a return pipe, said supply pipe including a relief pipe and relief valve branching from said supply pipe between said pump and said control valve;

a spring connecting said rocker arm slide shaft with the rocker arm for transmitting the movement of said rocker arm slide shaft to said rocker arm to move said rocker arm between longitudinally spaced, predetermined positions, each being aligned with one of said cams;

a first detector for sensing the temperature of the lubricant utilized in said hydraulic piston-cylinder;

a second detector for sensing the rotational speed of the engine; and a control, connecting said control valve and said first and second detectors, for switching said control valve in accordance with the rotational speed of said engine detected by said second detector only when said first detector detects that said temperature of the lubricant is higher than a predetermined temperature.

6. The variable valve event engine according to claim 3, 5 or 2, which further comprises a spring biased member releasably securing said rocker arm in said predetermined positions and being responsive to a predetermined level of biasing force in said connecting spring, said member releasing said rocker arm for longitudinal movement on said rocker shaft between said predetermined positions when the bias of said connecting spring against the secured rocker arm at least equals said predetermined level of biasing force.

7. The variable valve event engine according to claim 3, 5 or 2, wherein said rocker shaft is a hollow cylinder, said rocker arm sideshaft extends inside said hollow cylinder, and further comprising a spring bias member releasably securing said rocker arm in said predetermined position and being responsive to a predetermined level of biasing force in said connecting spring, said member releasing said rocker arm for longitudinal movement on said rocker shaft between said predetermined positions when the bias of said connecting spring against the secured rocker arm at least equals said predetermined level of biasing force.

8. The variable valve event engine according to claim 5, further comprising a third detector for sensing the load of said engine, said third detector being connected to said control such that said control switches the control valve in accordance with the rotational speed and the load of the engine detected by said second and third detectors only when said first detector detects tha the temperature of the lubricant is higher than said predetermined temperature.

9. The variable valve event engine according to claim 8 or 1, wherein said control includes three switches which are connected in series and are connected to said first, second and third detectors, respectively.

* * * * *